US011214960B2

(12) United States Patent
Llonch

(10) Patent No.: US 11,214,960 B2
(45) Date of Patent: Jan. 4, 2022

(54) MODULAR WALL GRAVITATIONAL ASSEMBLY SYSTEM

(71) Applicant: Carlos Gracia Llonch, Madrid (ES)

(72) Inventor: Carlos Gracia Llonch, Madrid (ES)

( * ) Notice: Subject to any disclaimer, the term of this patent is extended or adjusted under 35 U.S.C. 154(b) by 90 days.

(21) Appl. No.: 16/811,372

(22) Filed: Mar. 6, 2020

(65) Prior Publication Data

US 2020/0378113 A1 Dec. 3, 2020

Related U.S. Application Data

(60) Provisional application No. 62/855,317, filed on May 31, 2019.

(51) Int. Cl.
*E04B 2/74* (2006.01)
*E04B 2/82* (2006.01)
*E04B 2/78* (2006.01)

(52) U.S. Cl.
CPC ..... *E04B 2/7872* (2013.01); *E04B 2/7459* (2013.01); *E04B 2/7863* (2013.01); *E04B 2/821* (2013.01); *E04B 2002/7466* (2013.01)

(58) Field of Classification Search
CPC ..... E04B 2/74; E04B 2/7407; E04B 2/7453; E04B 2/7459; E04B 2/821; E04B 2/7863; E04B 2002/7461; E04B 2002/7466; E04B 2002/749
USPC ..... 52/39, 220.7, 239, 238.1, 481.2
See application file for complete search history.

(56) References Cited

U.S. PATENT DOCUMENTS 2,158,082 A * 5/1939 Morrell ..... E04B 2/7854 52/481.1
3,332,182 A * 7/1967 Mark ..... E04B 2/7453 52/127.12
3,471,978 A * 10/1969 Fenwick ..... A47F 5/103 52/36.6
3,537,217 A * 11/1970 Lickliter ..... E04B 2/825 52/126.4
5,522,193 A * 6/1996 Sommerstein ..... E04F 13/081 52/235
6,301,846 B1 * 10/2001 Waalkes ..... A47B 21/06 52/220.7

(Continued)

FOREIGN PATENT DOCUMENTS

EP 0738804 A1 * 10/1996 ..... E04B 2/7412
EP 2905394 A1 * 8/2015 ..... E04G 25/04

(Continued)

*Primary Examiner* — Ryan D Kwiecinski
(74) *Attorney, Agent, or Firm* — Patentfile, LLC; Bradley C. Fach; Steven R. Kick

(57) ABSTRACT

A modular wall gravitational assembly system may include a rail, a frame, a first stilt, and a second stilt. A top rail may be coupled to a hanging structure, such as ceiling, and may have a plurality of rail sockets. Each stilt may comprise a head, for coupling the stilt to a rail socket, and a foot, for coupling the stilt to a floor surface. A first stilt may have an active receiver that may include a first easement region and a first active rest. A second stilt may have a first passive receiver that may have a first passive rest. A frame may have a first pin and a second pin, and the frame may be supported by the first stilt and by the second stilt by placing the first pin in the first active rest and by placing the second pin in the first passive rest.

13 Claims, 17 Drawing Sheets

(56) References Cited

U.S. PATENT DOCUMENTS

| | | | | |
|---|---|---|---|---|
| 6,910,306 | B2 * | 6/2005 | Waalkes | A47B 21/06 52/220.7 |
| 7,454,867 | B2 * | 11/2008 | Nicoletti | E04B 2/7453 52/238.1 |
| 8,959,869 | B2 * | 2/2015 | Kordecki | E04G 25/065 52/708 |
| 10,400,449 | B2 * | 9/2019 | Ollila | B65G 11/00 |
| 2002/0157335 | A1 * | 10/2002 | Vos | E04B 2/821 52/238.1 |
| 2007/0261805 | A1 * | 11/2007 | Huang | E04B 2/763 160/371 |
| 2017/0342736 | A1 * | 11/2017 | Roshinsky | E04B 2/767 |
| 2021/0002894 | A1 * | 1/2021 | Van De Voorde | F16B 7/1454 |

FOREIGN PATENT DOCUMENTS

| | | | | |
|---|---|---|---|---|
| KR | 200426512 | Y1 * | 9/2006 | |
| WO | WO-8701751 | A1 * | 3/1987 | E04B 2/7863 |

* cited by examiner

MODULAR WALL GRAVITATIONAL ASSEMBLY SYSTEM

CROSS REFERENCE TO RELATED APPLICATIONS

This application claims priority to and the benefit of the filing date of U.S. Provisional Application No. 62/855,317, filed on May 31, 2019, entitled "MODULAR WALL GRAVITATIONAL ASSEMBLY SYSTEM", which is hereby incorporated by reference in its entirety.

FIELD OF THE INVENTION

This patent specification relates to the field of modular wall systems. More specifically, this patent specification relates to a modular wall system that is quickly and easily assembled and disassembled and in which the components may be reused after disassembly.

BACKGROUND

Modular walls are used for the construction and fabrication of many buildings, including the fabrication of both interior and exterior surfaces. Examples, include office Partitions, Stands, Bureaus, Labs, Sheds, Cabins, Industrial stuff, Warehouses, etc.

Existing modular walls require a division of labor for their fabrication and installation which is usually about 20 to 30% time in factory for fabrication and 70 to 80% time at building site for deployment and installation. Because of this ratio (factory time/deployment time), cost, quality, and delivery time of existing modular walls are not always well controlled.

Therefore, a need exists for novel modular wall systems which decrease the amount of time required for deployment and installation so as to make the use of modular wall systems more clean, recyclable, efficient, and quick to manufacture and deploy. A further need exists for novel modular wall systems which require less skill to install, are installed more accurately, and which allow the novel modular wall systems to be profitable at last.

BRIEF SUMMARY OF THE INVENTION

A modular wall gravitational assembly system is disclosed which provides a modular wall system which decreases the amount of time required for deployment and installation so as to make the use of modular wall systems more clean, efficient, quick, and profitable to manufacture and deploy. Additionally, the modular wall gravitational assembly system is just as easy to disassemble as it is to assemble it, so the system is 100% reusable.

In some embodiments, the system may include one or more top rails, frames, and stilts, such as a first stilt and a second stilt. A top rail may have a first rail socket, a second rail socket, and one or more rail apertures for receiving fasteners for coupling the top rail to a hanging structure, such as ceiling. A first stilt may have a first head, a first active receiver, and a first foot, and the first active receiver may include a first easement region and a first active rest. The first head may be configured to be removably coupled to the first rail socket, and the first foot may be configured to couple the first stilt to a floor surface. A second stilt may have a second head, a first passive receiver, and a second foot, and the first passive receiver may have a first passive rest. The second head may be configured to be removably coupled to the second rail socket, and the second foot may be configured to couple the second stilt to the floor surface. A frame may have a first pin and a second pin, and the frame may be supported by the first stilt and by the second stilt by placing the first pin in the first active rest and by placing the second pin in the first passive rest.

In further embodiments, the first stilt may include a second active receiver having a second active rest, and the frame may be supported by the first stilt by placing the first pin in both the first active rest and the second active rest.

In still further embodiments, the frame may include a first channel, the first active receiver may be coupled to a first body plate, and the second active receiver may be coupled to a second body plate. The first body plate and second body plate may be positioned in the first channel when the frame is supported by the first stilt and the second stilt.

In still further embodiments, the second stilt may include a second passive receiver having a second passive rest, and the frame may be supported by the second stilt by placing the second pin in both the first passive rest and second passive rest.

In yet further embodiments, the frame may include a second channel, the first passive receiver may be coupled to a third body plate, and the second passive receiver may be coupled to a fourth body plate. The third body plate and fourth body plate may be positioned in the second channel when the frame is supported by the first stilt and by the second stilt.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
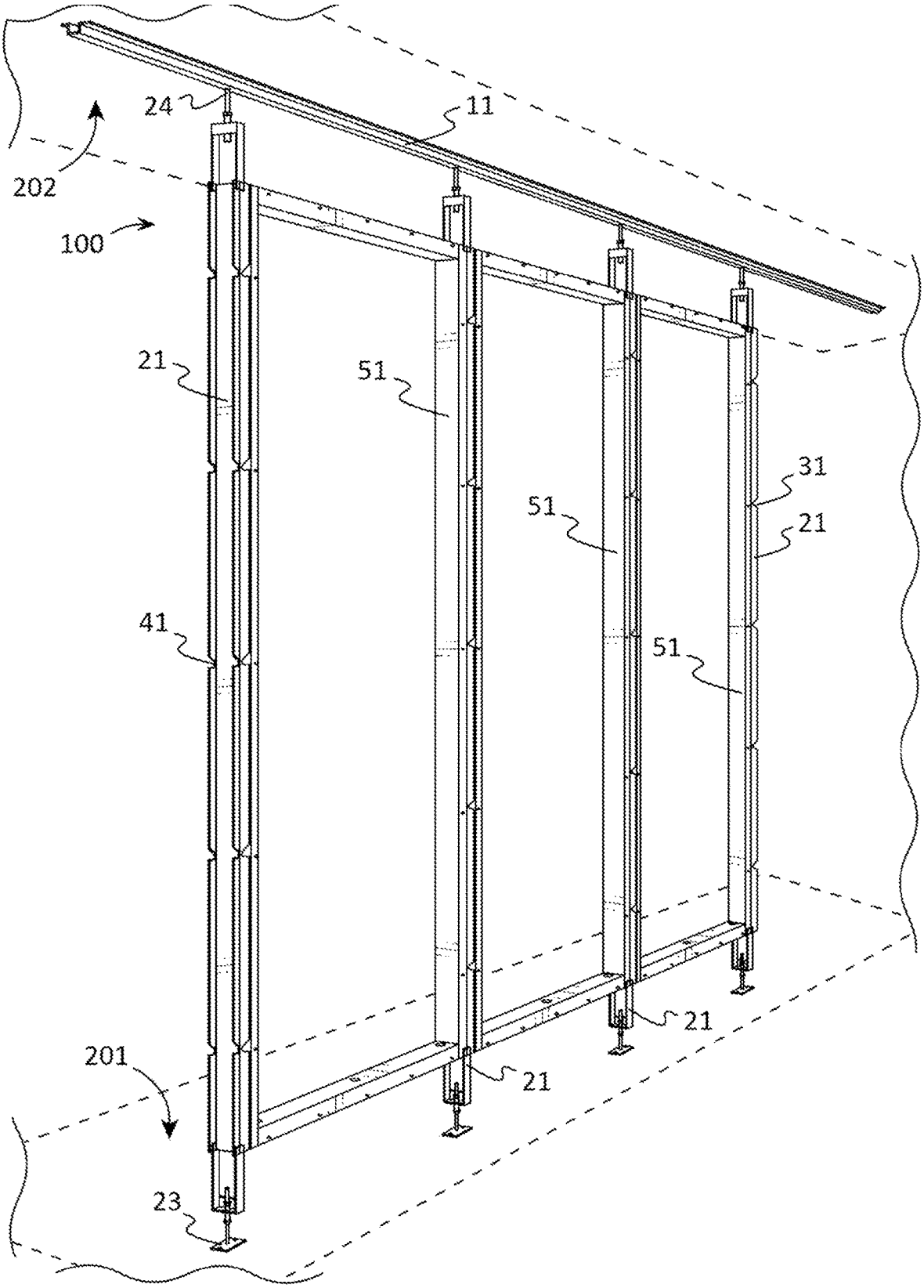
FIG. 1-FIG. 1 depicts a perspective view of an example of a modular wall gravitational assembly system according to various embodiments described herein.
Figure 2:
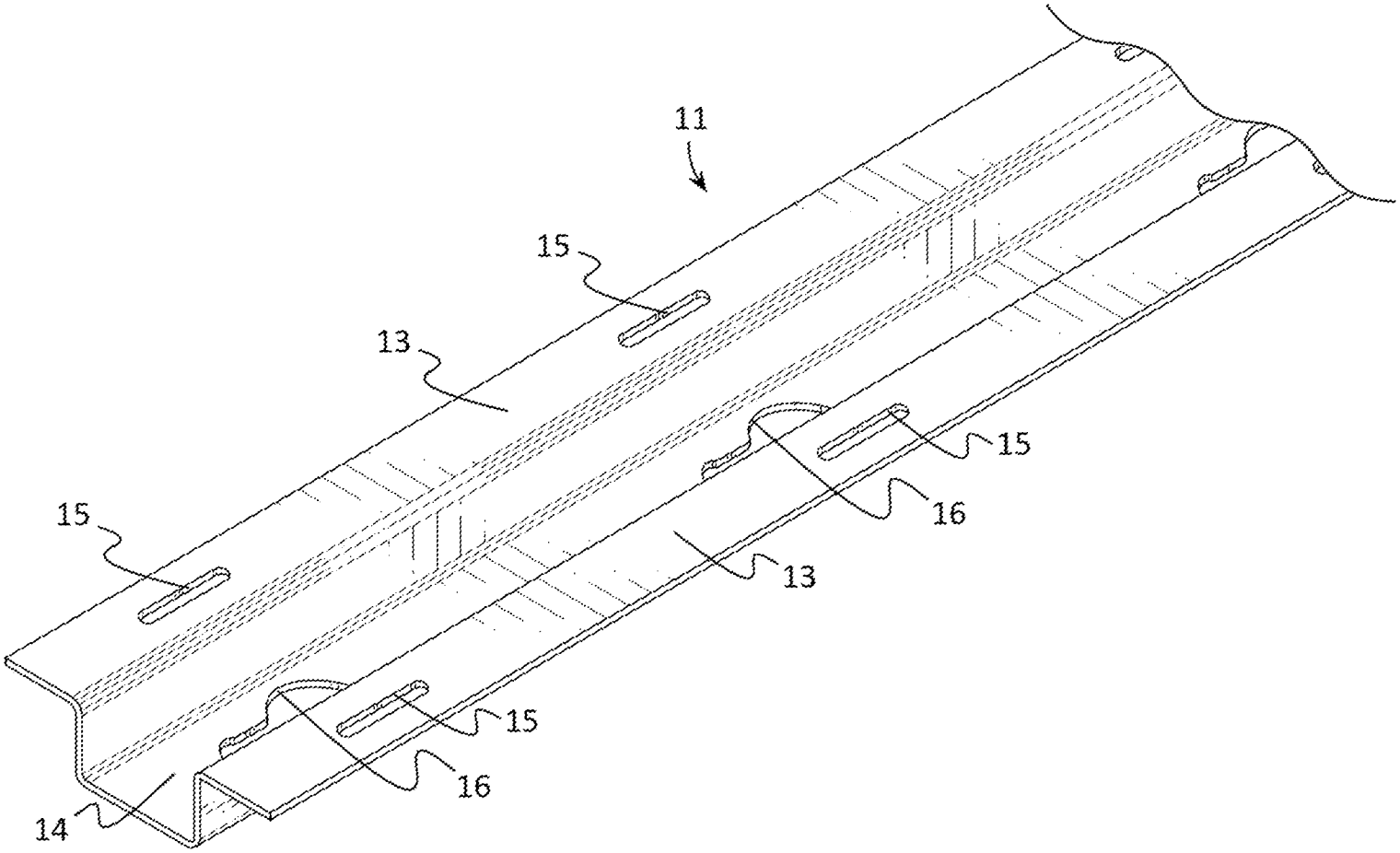
FIG. 2-FIG. 2 illustrates a top perspective view of an example of a top rail according to various embodiments described herein.
Figure 3:
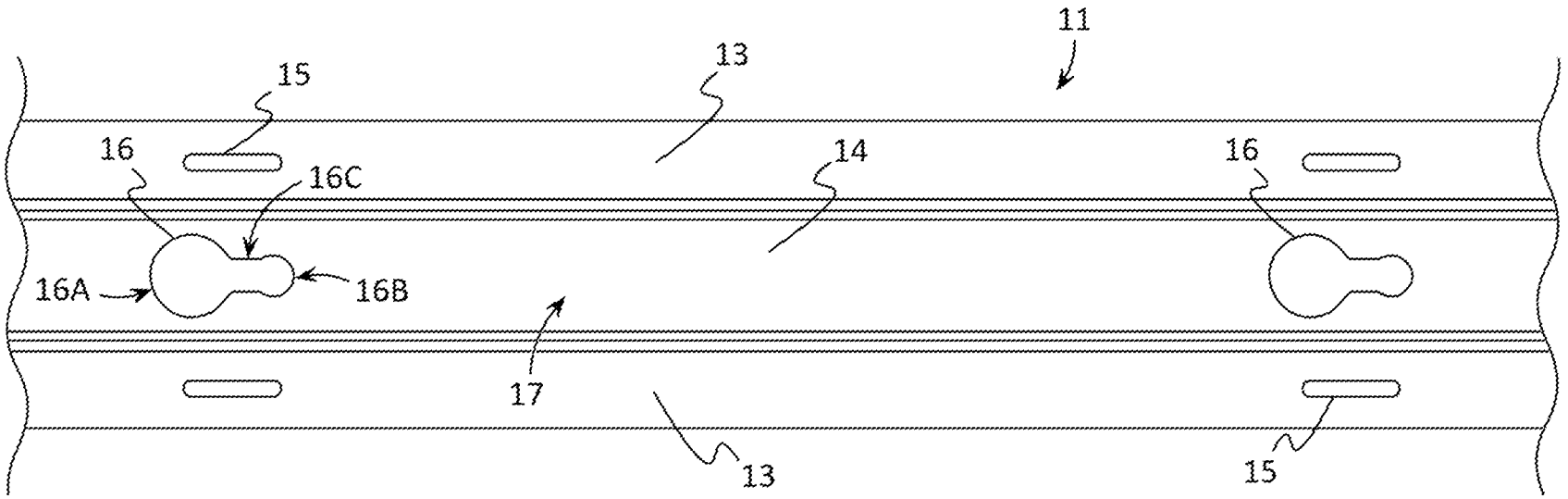
FIG. 3-FIG. 3 shows a bottom plan view of an example of a top rail according to various embodiments described herein.
Figure 4:
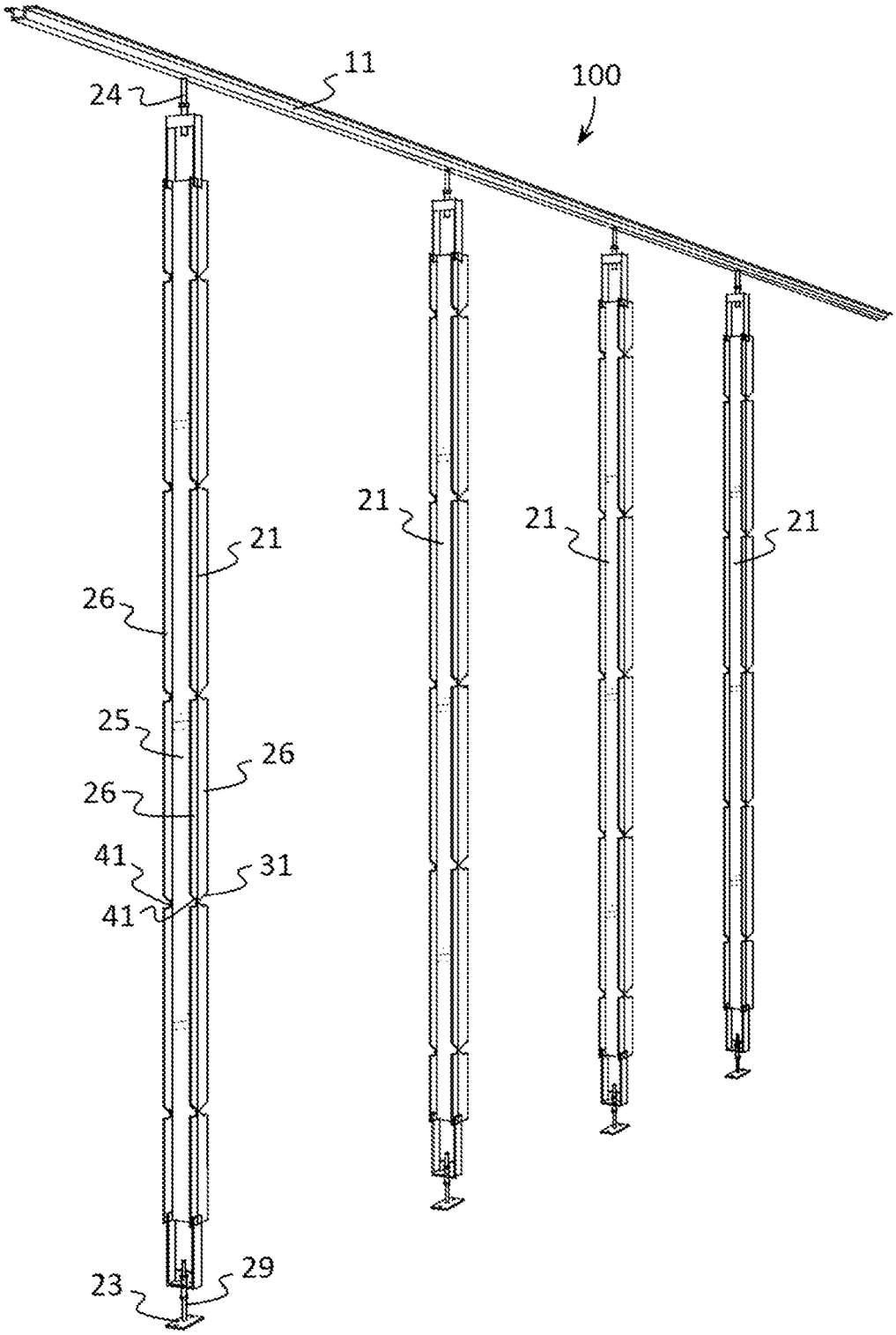
FIG. 4-FIG. 4 depicts a perspective view of example stilts coupled to a top rail according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new modular wall system is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIG. 1 illustrates an example of a modular wall gravitational assembly system ("the system") 100 according to various embodiments. In some embodiments, the system 100 may comprise a top rail 11 having a plurality of rail sockets 16, including a first rail socket 16 and a second rail socket 16. A first stilt 21 may have a first head 22, a first active receiver 31, and a first foot 23. The first head 22 may be configured to be removably coupled to the first rail socket 16, and the first foot 23 may be configured to couple the first stilt 21 to a floor surface 201. The first active receiver 31 may comprise a first easement region 32 and a first active rest 33. A second stilt 21 may have a second head 22, a first passive receiver 41, and a second foot 23. The second head 22 may be configured to be removably coupled to the second rail socket 16, the second foot 23 may be configured to couple the second stilt 21 to the floor surface 21, and the first passive receiver may have a first passive rest 42. A frame 51 having a first pin 52 and a second pin 52 may be coupled to the first stilt 21 and second stilt 21 so that the frame 51 is supported by both the first stilt 21 and the second stilt 21 by placing the first pin 52 in the first active rest 33 and by placing the second pin 52 in the first passive rest 42.

The system 100 may comprise one or more top rails 11 which may be configured to be coupled to a hanging structure 202, such as a ceiling or ceiling frame. Preferably, a top rail 11 may comprise a length of material, such as steel or aluminum. In some embodiments, a top rail 11 may comprise two upper plates 13 which may be coupled together and separated from each other via a lower plate 14. In further embodiments, a top rail 11 may comprise any number of upper plates 13 which may be coupled together and separated from each other via any number of lower plates 14.

Generally, an upper plate 13 may form a surface for contacting a structure that the top rail 11 may be coupled to, while a lower plate 14 may be positioned below the upper plates 13 of the top rail 11 relative to the hanging structure 202 that the top rail 11 may be coupled to. In some embodiments, a top rail 11 may comprise a rail channel 17. A rail channel 17 may be formed by the distance separating two upper plates 13 and the distance that a lower plate 14 is below the two upper plates 13. Once a top rail 11 is coupled to a hanging structure 202 the rail channel 17 may separate a rail socket 16 a distance from the hanging structure 202 so that the head 22 may be moved into and out of the rail socket 16.

In some embodiments, an upper plate 13 may comprise one or more rail apertures 15. Rail apertures 15 may be configured in any shape and size so as to receive a fastener, such as a screw, bolt, rivet, etc., which may be used to couple the top rail 11 to a hanging structure 202.

In some embodiments, a lower plate 14 may comprise one or more rail sockets 16. Rail sockets 16 may be shaped and sized to allow a head 22 to be inserted into and removably coupled or retained in a rail socket 16. In preferred embodiments, a rail socket 16 may comprise a passthrough aperture 16A which may be in communication with a retaining aperture 16B. Optionally, a passthrough aperture 16A may be in communication with a retaining aperture 16B via a socket channel 16C. A socket channel 16C may be any shape and size which may allow portions of a head 22 and/or neck 24 to be moved between a passthrough aperture 16A and a retaining aperture 16B. A head 22 may be inserted into and removed from the rail socket 16 via the passthrough aperture 16A so that the passthrough aperture 16A may be larger in size than the head 22. Once inserted into the passthrough aperture 16A, the head 22 may then be placed on the retaining aperture 16B, optionally by moving the neck 24 that the head 22 is attached to through the socket channel 16C. The retaining aperture 16B may be smaller in size than the head 22 so that the head 22 may not pass through the retaining aperture 16B. In this manner, a head 22 may be configured to be retained in a rail socket 16 by resting the head 22 in or on the retaining aperture 16B. In further preferred embodiments, the passthrough aperture 16A and retaining aperture 16B may be configured with an arc shape, while in other embodiments, one or both of the openings 16A, 16B, may be configured with any other shape.

One or more stilts 21 may be coupled to a top rail 11 by inserting a head 22 of a respective stilt 16 into a rail socket 16 to rest on a retaining aperture 16B of the respective rail socket 16. The stilts 21 may also be coupled to a floor surface 201 so that the stilts 21 extend between the floor surface 201 and the top rail 11. Frames 51 may then be coupled to the stilts 21, such as by coupling a frame 51 between two adjacent stilts 21. Preferably, the elements of a stilt 21 may be made from durable materials, such as steel, aluminum, hard plastics, or any other structural material.

Each stilt 21 may comprise one or more active receivers 31 and/or passive receivers 41 which may be used to removably couple a frame 51 to the stilt 21. Generally, a stilt 21 may comprise a body 25 having a head 22 coupled to one end (top end) of the body 25 and a foot 23 coupled to the opposing end (bottom end) of the body 25.

A head 22 may form the portion of a stilt 21 that is configured to removably couple the stilt 21 to a top rail 11. A head 22 may be configured in any shape and size which may be able to fit through a passthrough aperture 16A but not through a retaining aperture 16B. In preferred embodiments, a head 22 may be configured with a spheroid cap shape. A spheroid cap shape may comprise a section of a sphere or other spheroid shape. A spheroid may comprise a sphere, a prolate spheroid, an oblate spheroid, or any other generally rounded three-dimensional shape. A spheroid cap is a portion of a spheroid cut off by a plane. For example, if the plane passes through the center of the sphere, so that the height of the cap is equal to the radius of the sphere, the spheroid cap is called a hemisphere. The portion of a spheroid cut off by a plane of a spheroid cap shape may then be coupled to a neck 24 or other portion of the stilt 21, such as the body 25. The spheroid portion of the head 22 may rest on a retaining aperture 16B to freely move to allow the stilt 25 to align perpendicular to the floor surface 201, hanging structure 202, and/or otherwise be plumb with the earth similar to a ball and socket joint (with the spheroid portion of the head 22 acting as the ball and the retaining aperture 16B acting as the socket).

Figure 7:
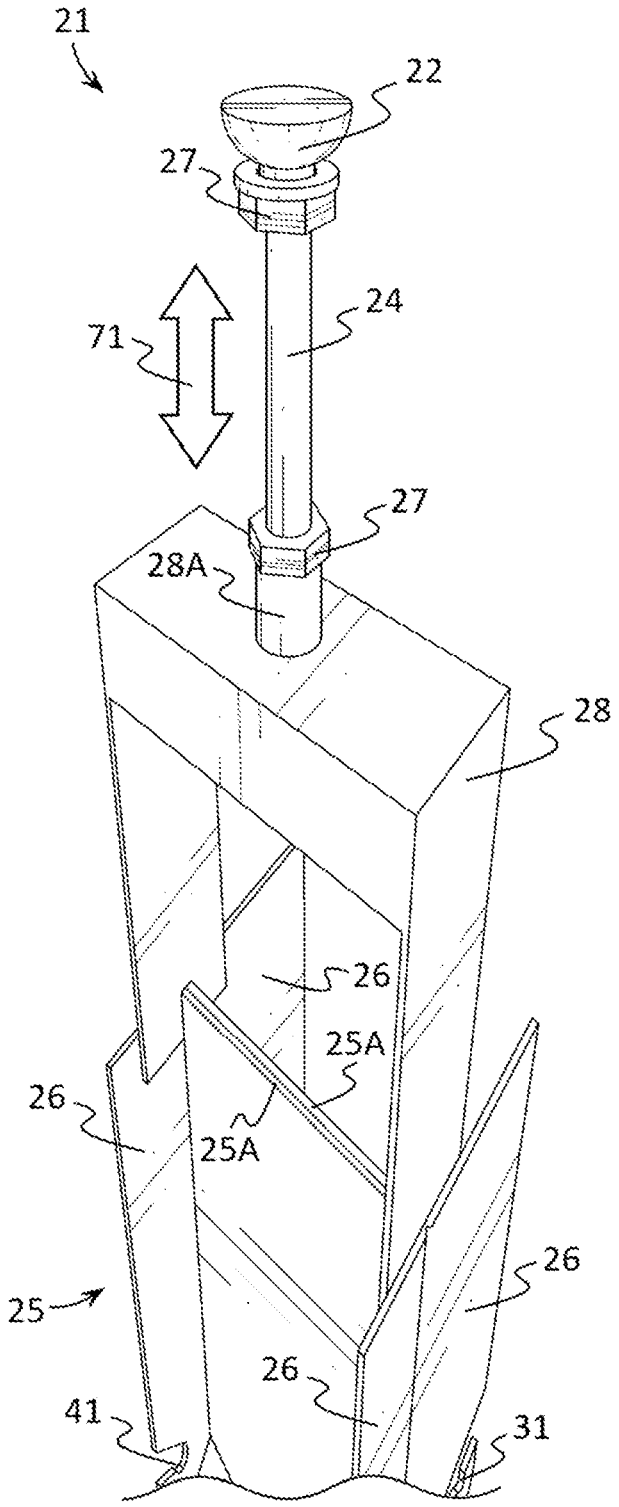
FIG. 7-FIG. 7 depicts a top perspective view of an example of a top portion of a stilt according to various embodiments described herein.

In some embodiments, a stilt 21 may comprise a neck 24 which may couple a head 22 to an upper portion of the body 25 of the stilt 21. In preferred embodiments, a neck 24 may be configured to movably couple the head 22 to the body 25 so that the head 22 may be movable relative to an active 31 and/or passive 41 receiver, such as by being movable towards and/or away from the active 31 and/or passive 41 receiver(s), of the stilt 21 (as shown by the arrows 71 in FIG. 7). In further preferred embodiments, a neck 24 may be configured to movably couple the head 22 to the body 25 so that the head 22 may be movable relative to the body 25 of the stilt 21, such as by being movable towards and/or away from the body 25. For example, a neck 24 may be threadedly engaged to a body 25 via threading and/or one or more movable fasteners 27 so that by rotating the neck 24 and/or movable fasteners 27 the neck 24 may allow the head 22 to be moved towards and away from the body 25 and therefore towards and away from its one or more active 31 and/or passive 41 receivers. In further embodiments, a stilt 21 may comprise a neck bracket 28 having a threaded neck portion 28A which may be coupled to the body 25 and which may movably couple the neck 24 to the neck bracket 28.

A foot 23 may form the portion of a stilt 21 that is configured to couple, preferably removably couple, the stilt 21 to a floor surface 201 and/or other object that may be coupled to the floor surface 201. A foot 23 may be configured in any shape and size, such as a rectangular prism shape. In preferred embodiments, a foot 23 may comprise one or more foot apertures 62 which may receive a fastener, such as a screw, bolt, rivet, etc., which may be used to couple the foot to a floor surface 201 and/or other object that may be coupled to the floor surface 201.

Figure 8:
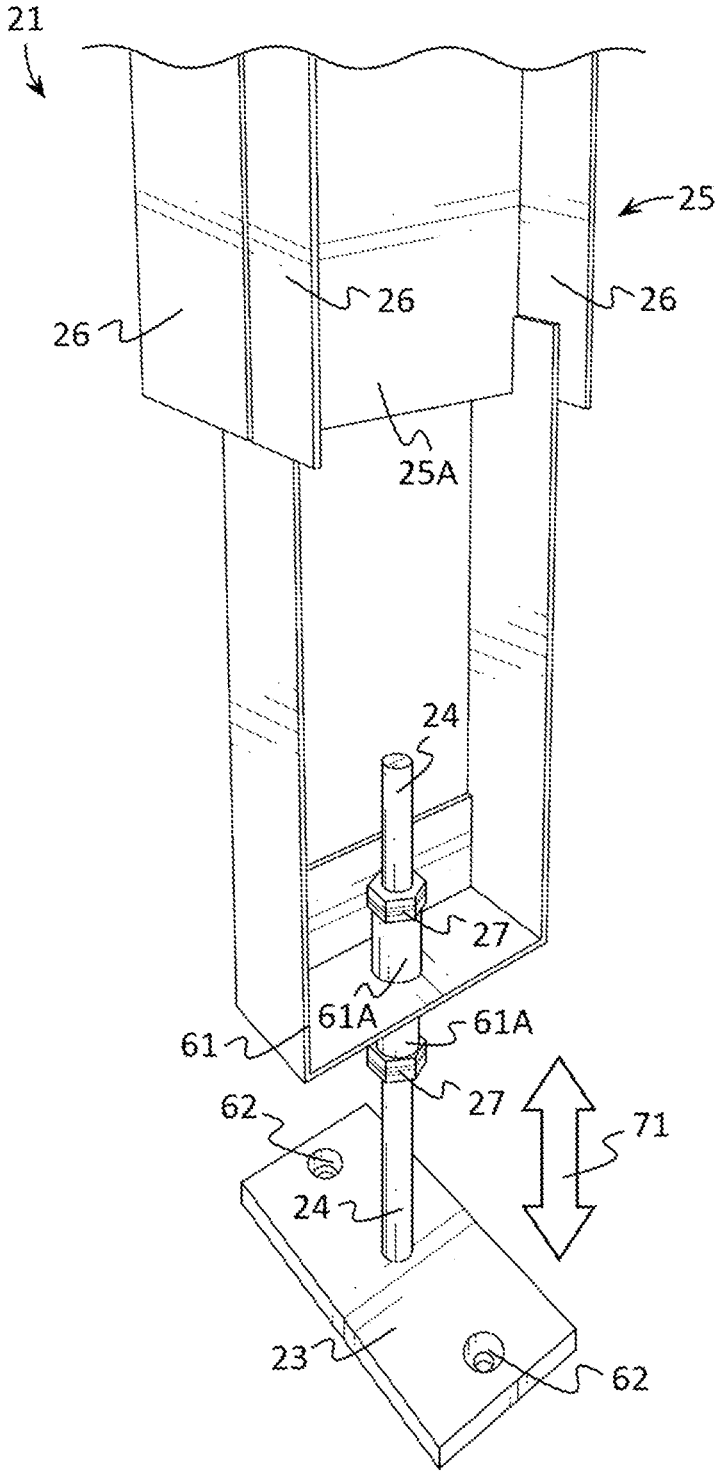
FIG. 8-FIG. 8 illustrates a top perspective view of an example of a bottom portion of a stilt according to various embodiments described herein.

In some embodiments, a stilt 21 may comprise a leg 29 which may couple a foot 23 to a lower portion of the body 25 of the stilt 21. In preferred embodiments, a leg 29 may be configured to movably couple the foot 23 to the body 25 so that the foot 23 may be movable relative to an active 31 and/or passive 41 receiver, such as by being movable towards and/or away from the active 31 and/or passive 41 receiver, of the stilt 21 (as shown by the arrows 71 in FIG. 8) In further preferred embodiments, a leg 29 may be configured to movably couple the foot 23 to the body 25 so that the foot 23 may be movable relative to the body 25 of the stilt 21, such as by being movable towards and/or away from the body 25. For example, a leg 29 may be threadedly engaged to a body 25 via threading and/or one or more movable fasteners 27 so that by rotating the leg 29 and/or movable fasteners 27 the leg 29 may allow the foot 23 to be moved towards and away from the body 25 and therefore towards and away from its one or more active 31 and/or passive 41 receivers. In further embodiments, a stilt 21 may comprise a leg bracket 61 having a threaded leg portion 61A which may be coupled to the body 25 and which may movably couple the neck leg 29 to the leg bracket 61.

The body 25 may comprise one or more active receivers 31 and/or passive receivers 41. In preferred embodiments, the one or more active receivers 31 of a stilt 21 may be positioned on opposite sides of the body 25 relative to the one or more passive receivers 41 of the stilt 21. In further embodiments, a body 25 may comprise one or more body plates 26 into which the one or more active receivers 31 and/or passive receivers 41 may be formed or coupled. In preferred embodiments, a body 25 may comprise four body plates 26 with a first pair of body plates 26 extending down one side of the stilt 21 and the second pair of body plates 26 extending down the opposite side of the stilt 21. In further embodiments, the first pair of body plates 26 may each comprise one or more active receivers 31 and the second pair of body plates 26 may each comprise one or more passive receivers 41.

Figure 5:
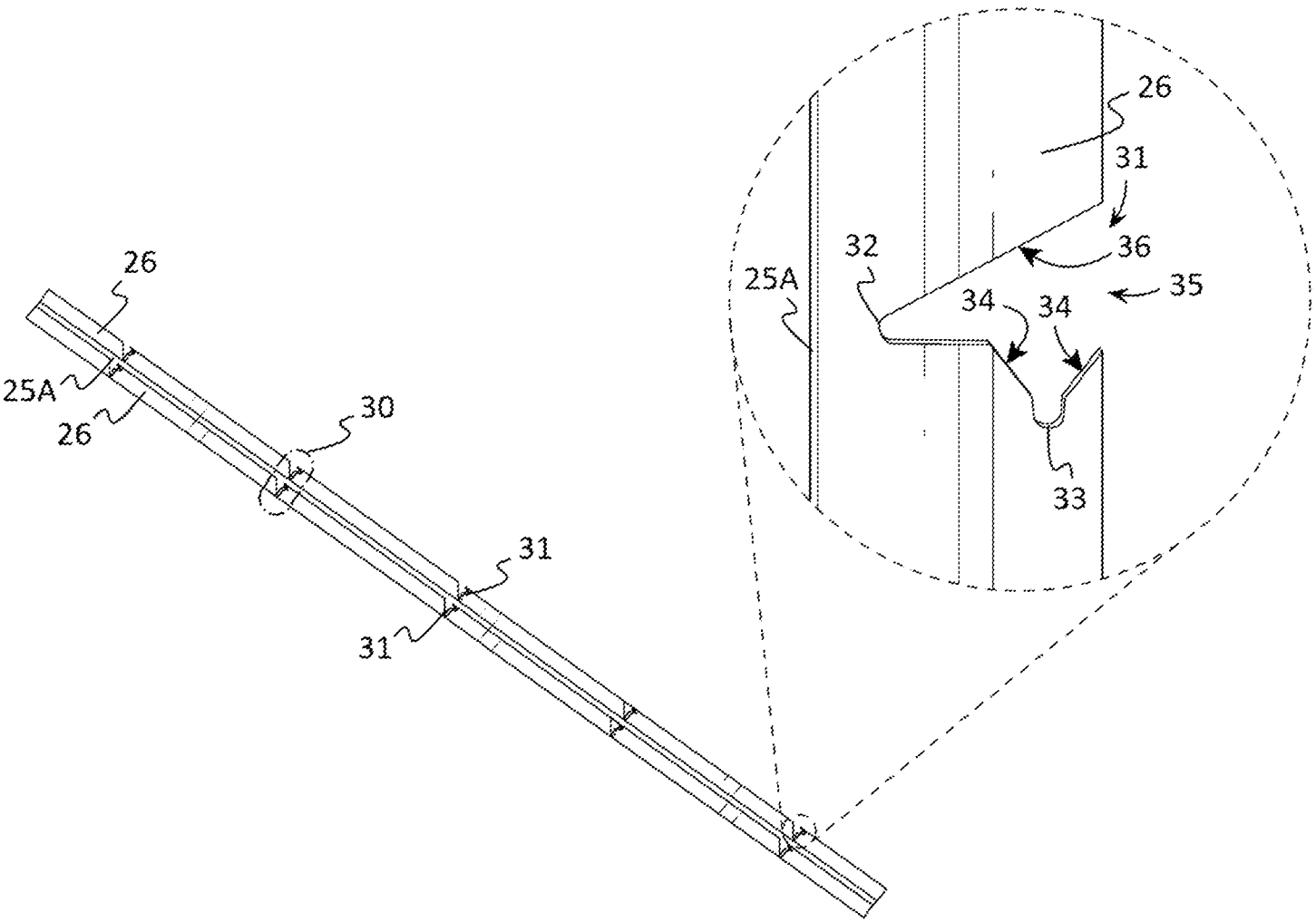
FIG. 5-FIG. 5 illustrates a top perspective view of an example of a body spine coupled to two body plates, each plate having active receivers, which may be used to form portions of the body of a stilt with an enlarged view of an active receiver according to various embodiments described herein.
Figure 6:
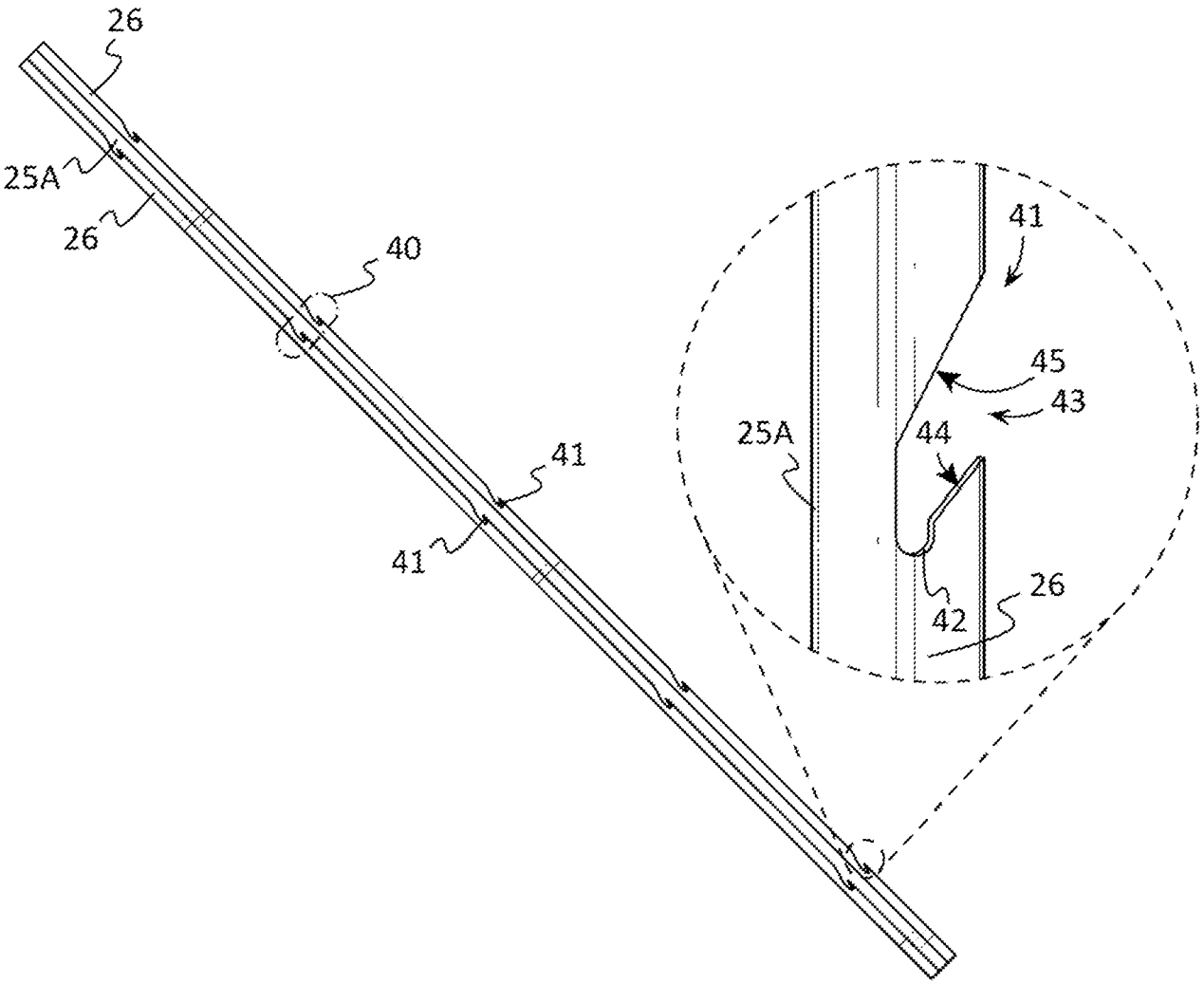
FIG. 6-FIG. 6 shows a top perspective view of an example of a body spine coupled to two body plates, each plate having passive receivers, which may be used to form portions of the body of a stilt with an enlarged view of a passive receiver according to various embodiments described herein.

In some embodiments, a one or more body plates 26 may be coupled to a body spine 25A. One or more body spines 25A may form all or portions of the body 25 of a stilt 21. For example, a first body spine 25A coupling two body plates 26, each body plate 26 having active receivers 31 (as shown in FIG. 5) and a second body spine 25A coupling two other body plates 26, each of those body plates 26 having passive receivers 41 (as shown in FIG. 6) may be used to form the body 25 of a stilt 21 by coupling the two body spines 25A together so that the active receivers 31 are separated from the passive receivers 41 by the two body spines 25A (active receivers 31 and passive receivers 41 positioned on opposite sides of the body 25).

An active receiver 31 may comprise an active opening 35 which may allow a pin 52 of a frame 51 to enter the active receiver 31 and to be moved into the easement region 32 or active rest 33. Generally, an active rest 33 may comprise a recess into the body 25 into which a pin 52 may fit into and rest on via the action of gravity. An active rest 33 is positioned below the active opening 35 and the easement region 32. An active rest 33 may be complementary in shape to a pin 52 of a frame 51 so that once the pin 52 is in the active rest 33 the pin 52 may fit snuggly to minimize movement of the pin 52 in the active rest 33. In some embodiments, an active receiver 31 of a stilt 21 may comprise an active rest 33 which may form the lowest portion of the active receiver 31 and into which a portion of a pin 52 of a frame 51 may come to rest when the pin 52 is positioned in the active rest 33 while the stilt 21 is supporting the frame 51. In this manner, an active rest 33 may comprise the portion of an active receiver 31 that is positioned relatively farther from the head 22 and relatively closer to the foot 23 of the stilt 21.

An active receiver 31 may comprise an easement region 32. Generally, an easement region 32 may comprise a recess into the body 25 (such as into a body plate 26) which may be positioned across from the active opening 35 and into which a pin 52 may fit into. While two stilts 21 may be positioned so that the active rest 33 of the first stilt 21 and passive rest 42 of the second stilt 21 are separated by a distance equal to the distance separating a pin 52 on one side (e.g. left side) of a frame 51 from a pin 52 on the other side (e.g. right side) of the frame 51, an easement region 32 may extend a greater distance into the body 25 than the active rest 33 so that once a pin 52 on one side (e.g. left side) of the frame 51 is positioned in the easement region 32, the pin 52 on the other side (e.g. right side) may then be moved into the passive receiver 40 and its passive rest 42.

In some embodiments, an active receiver 31 of a stilt 21 may comprise one or more active funnel surfaces 34, such as a first active funnel surface 34 and a second active funnel surface 34, which may be positioned above an active rest 33 and which may be in communication with the active rest 33. Generally, an active funnel surface 34 may comprise a surface angled between 5 and 89 degrees from vertical above the active rest 33. The one or more active funnel surfaces 34 may guide a pin 52 to settle into an active rest 33, such as via the action of gravity.

In some embodiments, an active receiver 31 of a stilt 21 may comprise an active guide surface 36 which may be positioned above an active rest 33. As a pin 52 is moved into an active receiver 31 and into contact with an active guide surface 36, the active guide surface 36 may be angled down towards the easement region 32 to guide the pin 52 into portions of the easement region 32 that are distal to the active opening 35. Generally, an active guide surface 36 may comprise a surface angled between 5 and 89 degrees from vertical.

A passive receiver 41 may comprise a passive opening 43 which may allow a pin 52 of a frame 51 to enter the passive receiver 41 and to be moved into the passive rest 42. Generally, a passive rest 42 may comprise a recess into the body 25 into which a pin 52 may fit into and rest on via the action of gravity. A passive rest 42 is positioned below the passive opening 43 and passive funnel surface(s) 44. A passive rest 42 may be complementary in shape to a pin 52 of a frame 51 so that once the pin 52 is in the passive rest 42 the pin 52 may fit snuggly to minimize movement of the pin 52 in the passive rest 42. In some embodiments, a passive receiver 41 of a stilt 21 may comprise a passive rest 42 which may form the lowest portion of the passive receiver 41 and into which a portion of a pin 52 of a frame 51 may come to rest when the pin 52 is positioned in the passive rest 42 while the stilt 21 is supporting the frame 51. In this manner, a passive rest 42 may comprise the portion of a passive receiver 41 that is positioned relatively farther from the head 22 and relatively closer to the foot 23 of the stilt 21.

In some embodiments, a passive receiver 41 of a stilt 21 may comprise one or more passive funnel surfaces 44 which may be positioned above a passive rest 42 and which may be in communication with the passive rest 42. Generally, a passive funnel surface 44 may comprise a surface angled between 5 and 89 degrees from vertical above the passive rest 42. The one or more passive funnel surfaces 44 may guide a pin 52 to settle into a passive rest 42, such as via the action of gravity.

In some embodiments, a passive receiver 41 of a stilt 21 may comprise a passive guide surface 45, such as a first passive guide surface 45 and a second passive guide surface 45, which may be positioned above a passive rest 42. As a pin 52 is moved into a passive receiver 41 and into contact with a passive guide surface 45, and the passive guide surface 45 may be angled down towards the passive rest 42 to guide the pin 52 down into the passive rest 42. Generally, a passive guide surface 45 may comprise a surface angled between 0 and 89 degrees from vertical.

The system 100 may comprise one or more frames 51 which may be suspended from a top rail 11 by coupling each frame 51 to two adjacent stilts 21 that are in turn coupled to the top rail 11. A frame 51 may be configured in any shape and size. Preferably, a frame 51 may comprise a rectangular shape. A frame 51 may comprise one or more sidewalls, such as a first sidewall 53, a second sidewall 54, a third sidewall 55, and a fourth sidewall 56, which may be coupled together to form the overall shape of the frame 51. For example, four sidewalls 53, 54, 55, 56, may be coupled together so that the first 53 and third 55 sidewall are parallel to each other but perpendicular to the second 54 and fourth 56 sidewalls, while the second 54 and fourth 56 sidewalls are parallel to each other.

Figure 9A:
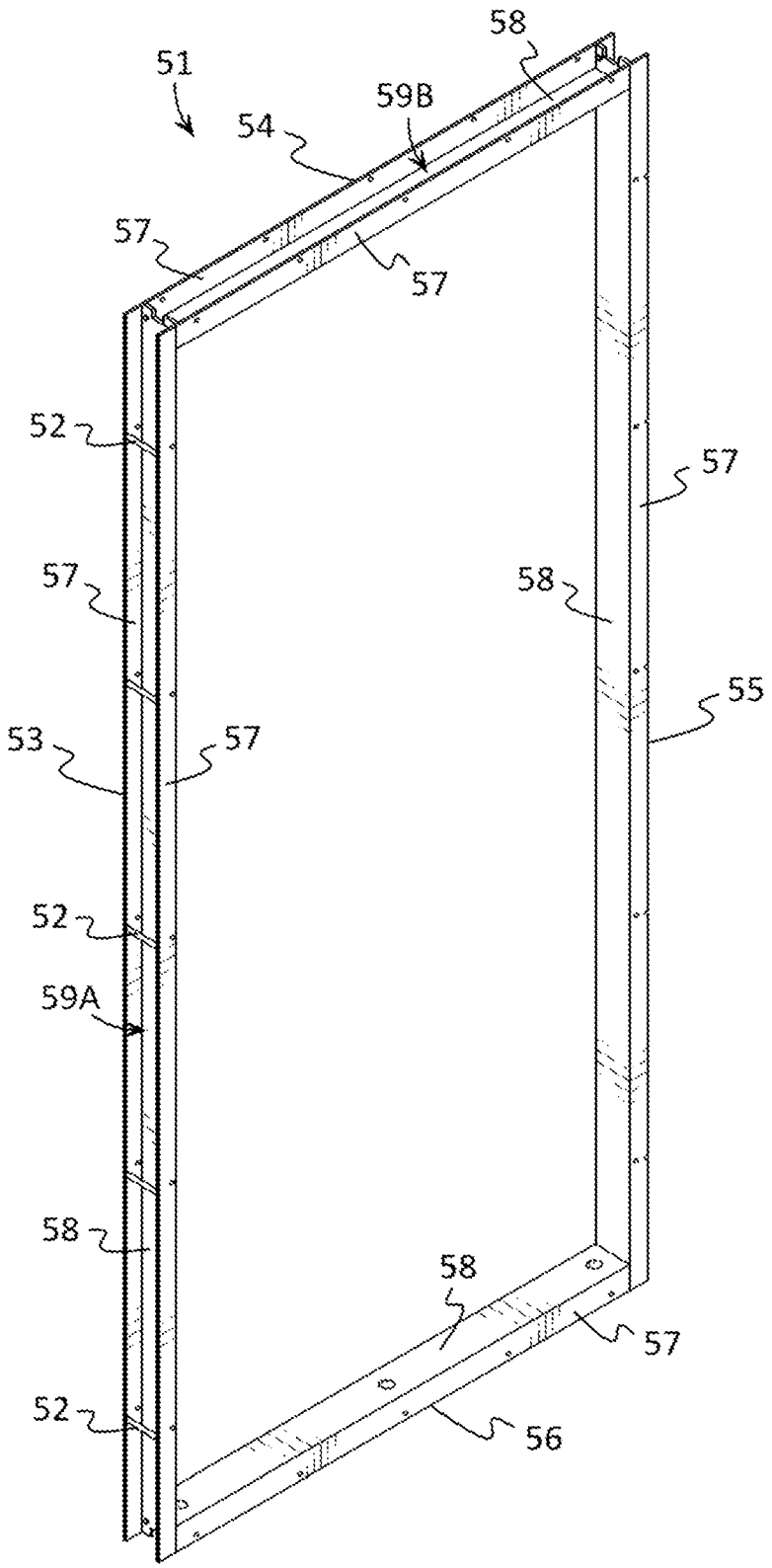
FIG. 9A-FIG. 9A shows a top perspective view of an example of a frame according to various embodiments described herein.
Figure 9B:
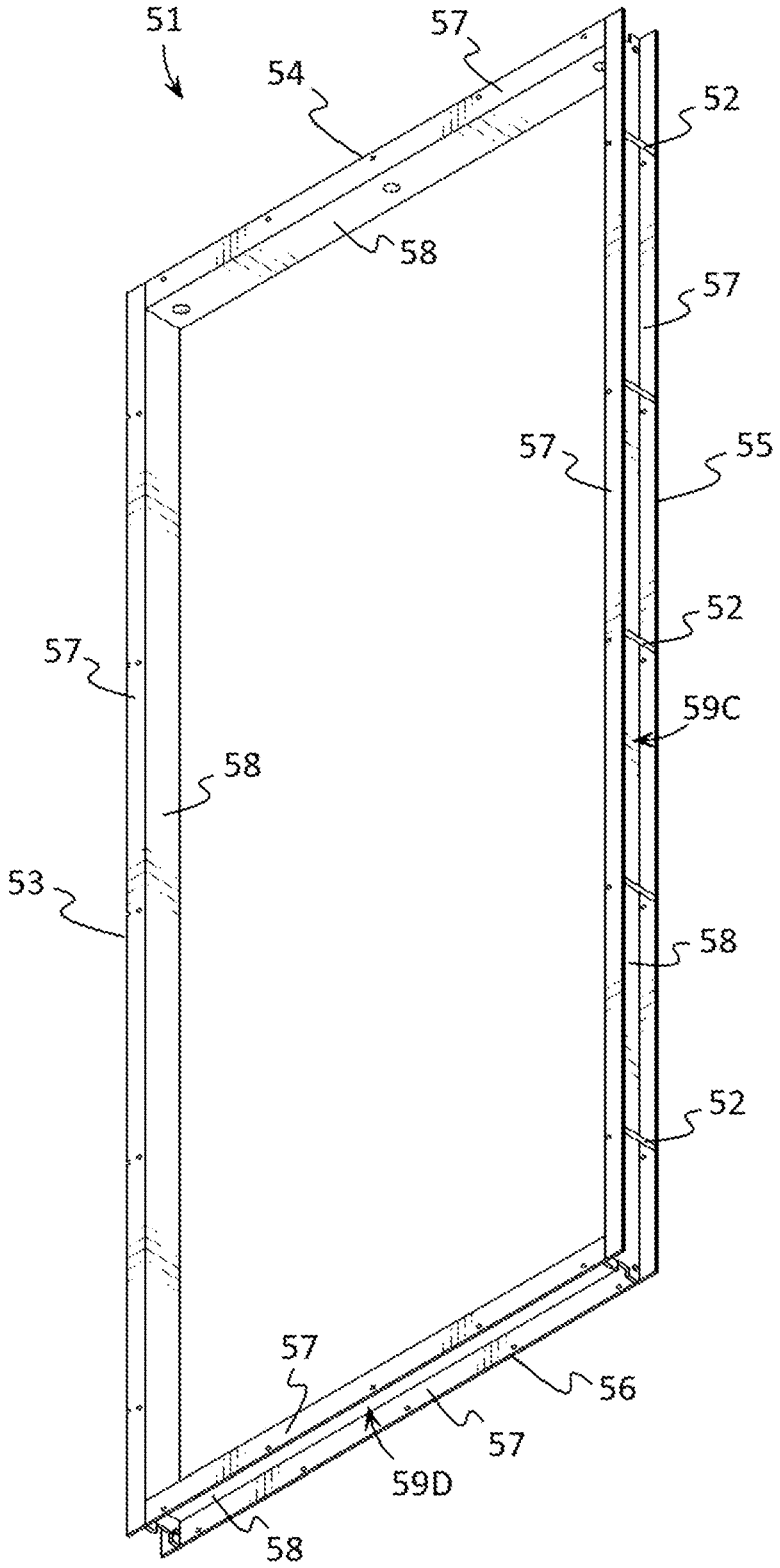
FIG. 9B-FIG. 9B depicts a bottom perspective view of the example frame of FIG. 9A according to various embodiments described herein.

In preferred embodiments, each sidewall 53, 54, 55, 56, may comprise two frame plates 57 which may be coupled to a frame spine 58. Each sidewall 53, 54, 55, 56, may comprise a channel 59, such as a first channel 59A, second channel 59B, third channel 59C, and a fourth channel 59D (FIGS. 9A and 9B). Generally a channel 59 may be formed by the two frame plates 57 and frame spine 58 of a respective sidewall 53, 54, 55, 56. In preferred embodiments, the frame plates 57 of a frame 51 may be separated by a greater distance than the body plates 26 of a stilt 21 so that the body plates 26 may fit into the channel 59 and between the frame plates 57.

Each frame 51 may comprise one or more pins 52, such as a plurality of pins 52, which may be coupled to one or more sidewalls 53, 54, 55, 56. In some embodiments, one or more pins 52 may be coupled to one or more sidewalls 53, 54, 55, 56, between and to the two frame plates 57 and/or frame spine 58, such as in a channel 59, of a sidewall 53, 54, 55, 56. Pins 52 may be configured in any size and shape. In preferred embodiments, one or more pins 52 may comprise an elongated cylinder shape. In other embodiments, one or more pins 52 may comprise an elongated rectangular prism shape, triangular prism shape, hexagonal prism shape, or any other shape, including combinations of shapes.

Figure 10:
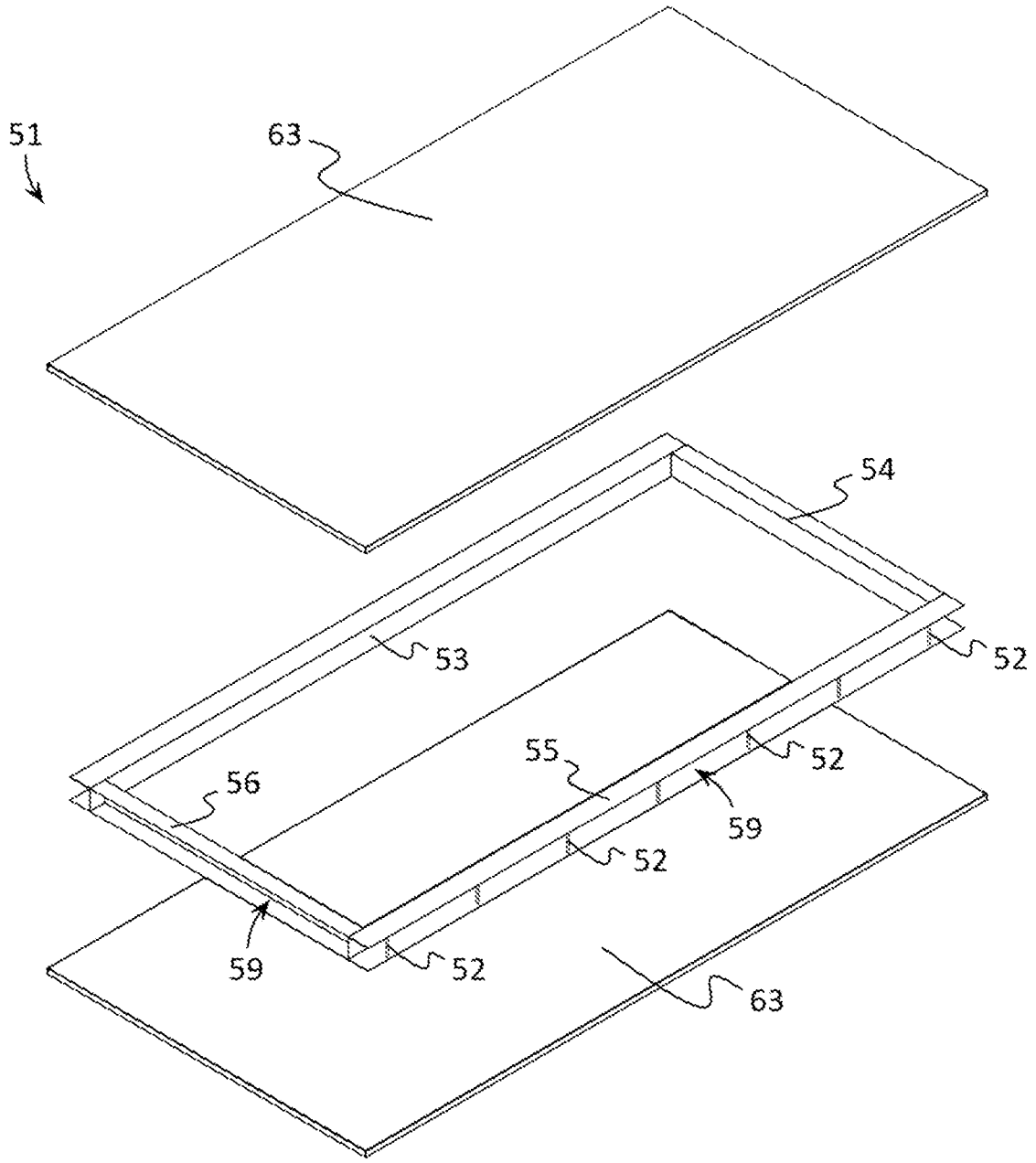
FIG. 10-FIG. 10 illustrates a perspective exploded view of another example of a frame, the frame including two panels according to various embodiments described herein.

In some embodiments, a frame 51 may comprise one or more panels 63, such as a first panel 63 and a second panel 63 (FIG. 10) which may be coupled to the sidewalls 53, 54, 55, 56. A panel 63 may comprise drywall, wood, metal plates, a door, window, or any other material or feature which may be used to form a building wall or which may be coupled to a building wall. Additionally, insulation and/or other materials, such as plumbing and wiring, may be coupled between the panels 63. It should be understood that the frame 51 is not limited to building materials provided and they are simply examples.

Turning now to FIGS. 11-16, an example of how a frame 51 may be coupled to and between two adjacent stilts 21 is provided. The example frame 51 and stilts 21 are not drawn to scale simply to more clearly illustrate the engagement between the elements of the frame 51 and the elements of the stilts 21, however, frames 51 and stilts 21 may be configured in any size and shape. In some embodiments, the body 25 of a stilt 21 may comprise a first pair of body plates 26 having a number of sets 30 of active receivers 31 (FIG. 5) and/or the body 25 may comprise a second pair of body plates 26 having a number of sets 40 of passive receivers 41 (FIG. 6). A set of active receivers 30 may comprise two or more active receivers 31 which may be positioned on their respective body plates 26 so that the easement region 32 and active rest 33 of each active receiver 31 of a respective set of active receivers 30 is approximately equidistant from the head 22 and/or foot 23 of the stilt 21. A set of passive receivers 40 may comprise two or more passive receivers 41 which may be positioned on their respective body plates 26 so that the passive rest 42 of each passive receiver 41 of a respective set of passive receivers 40 is approximately equidistant from the head 22 and or foot 23 of the stilt 21.

In the example of FIGS. 11-16, a first stilt 21A comprises a number of active receiver sets 30 of two active receivers 31 with each active receiver 31 having an active rest 33 and an easement region 32. The first stilt 21A also comprises a number of passive receiver sets 40 of two passive receivers 41 which are not used by the illustrated frame 51 but which may be used with another frame 51 that may be coupled to the other side of the stilt 21A. The second stilt 21B comprises a number of passive receiver sets 40 of two passive receivers 41 with each passive receiver 41 having a passive rest 42. The second stilt 21B also comprises a number of active receiver sets 30 which are not used by the illustrated frame 51 in FIGS. 11-16 but which may be used with another frame 51 that may be coupled to the other side of the stilt 21B.

Figure 11:
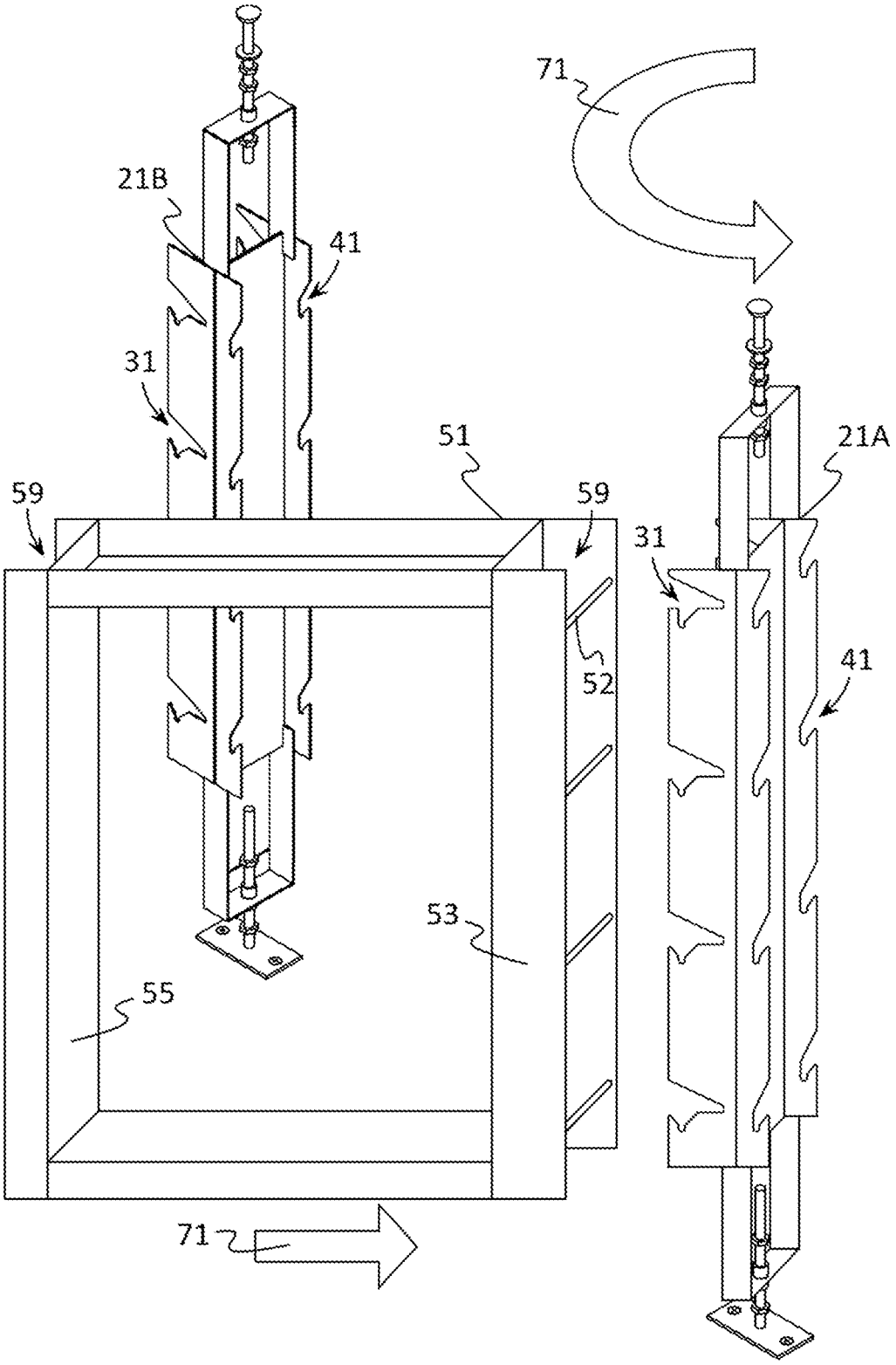
FIG. 11-FIG. 11 shows a perspective view of two adjacent, example stilts and an example frame prior to being coupled to the stilts according to various embodiments described herein.
Figure 12:
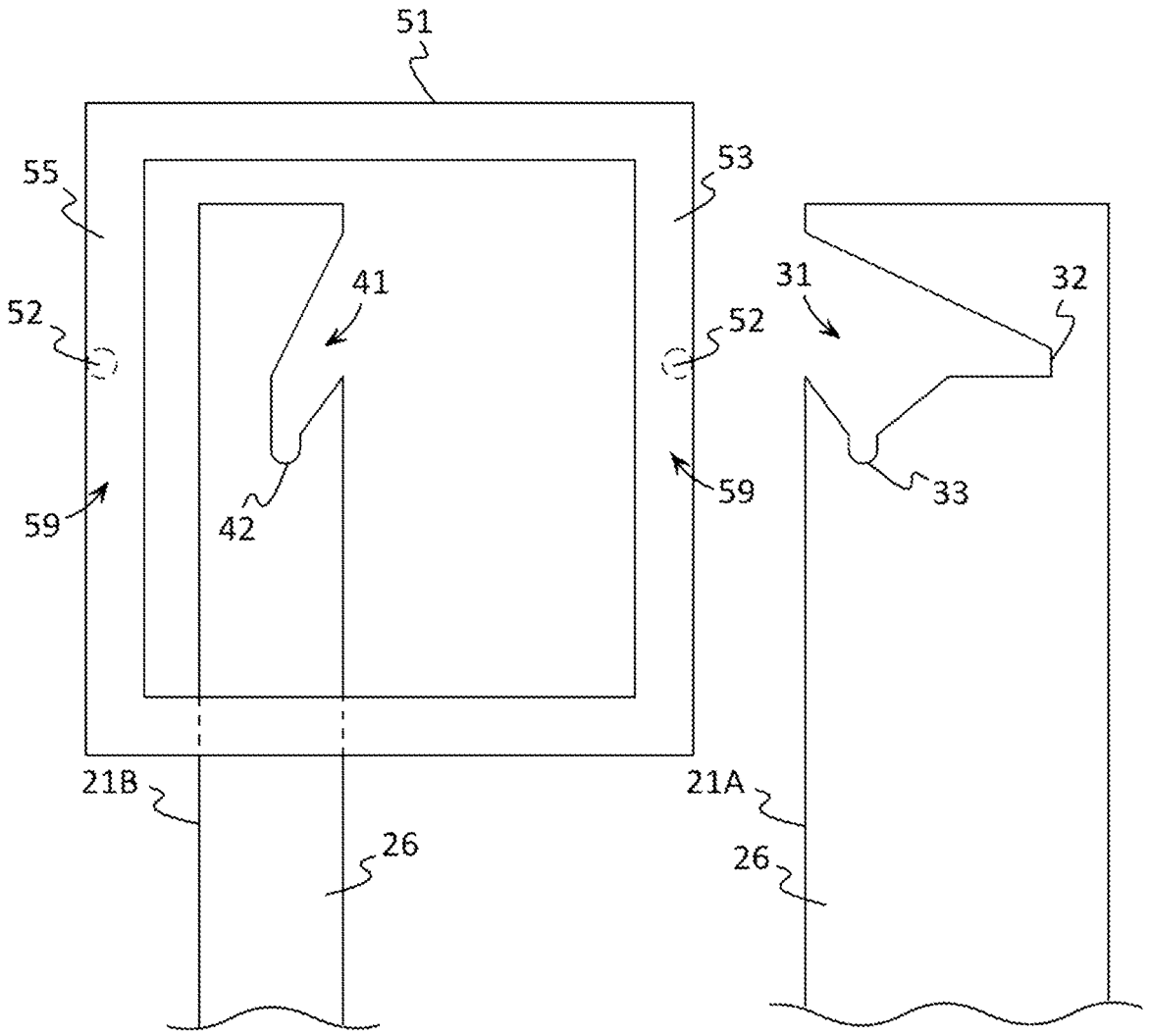
FIG. 12-FIG. 12 depicts a schematic diagram (elements not drawn to scale) of the stilts and frame from FIG. 11 according to various embodiments described herein.
Figure 13:
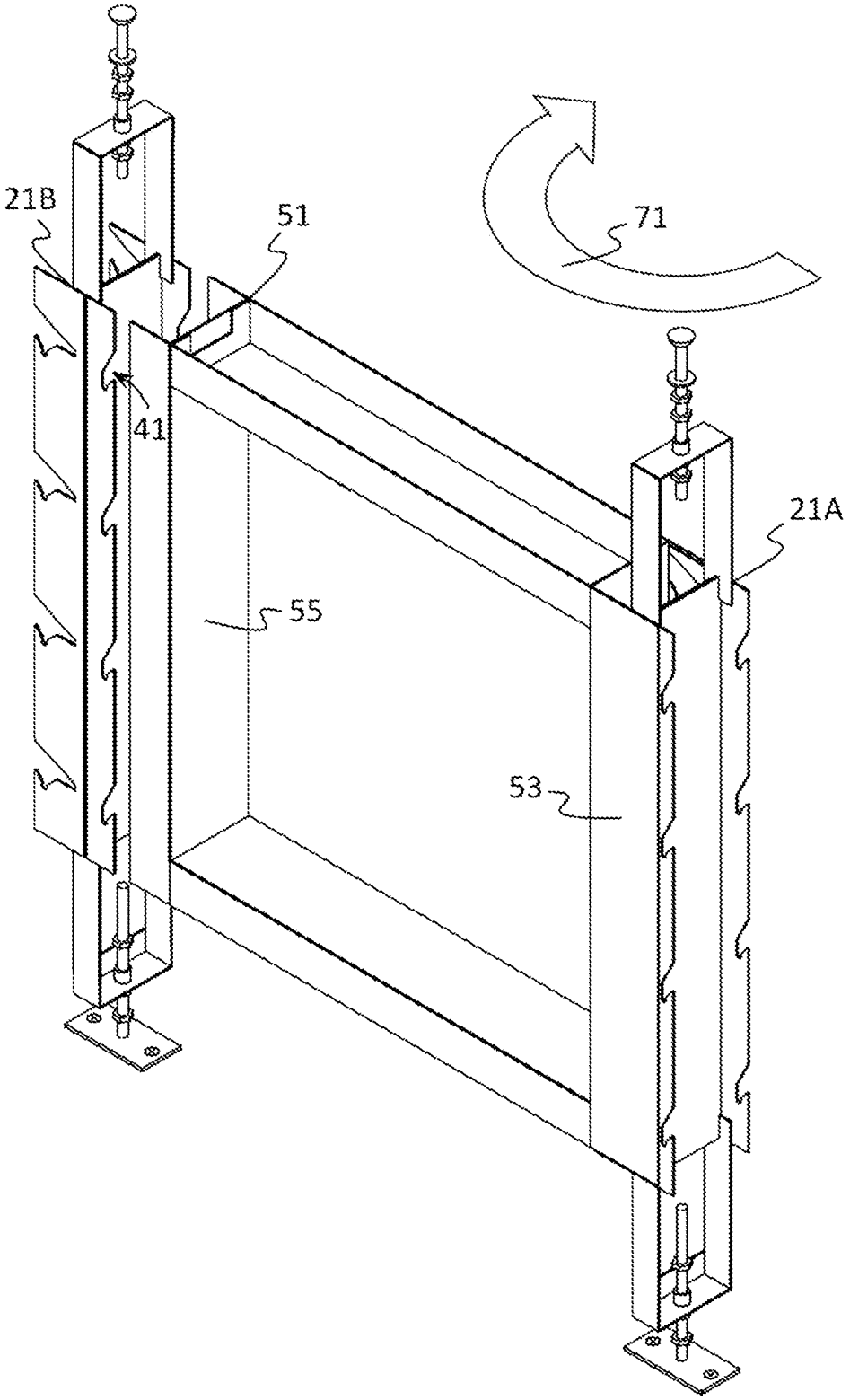
FIG. 13-FIG. 13 illustrates a perspective view of the stilts and frame from FIG. 11 in which a pin of the frame is positioned in an active receiver of the first stilt and prior to the positioning of a pin on the opposite side of the frame in a passive receiver of the second stilt according to various embodiments described herein.
Figure 14:
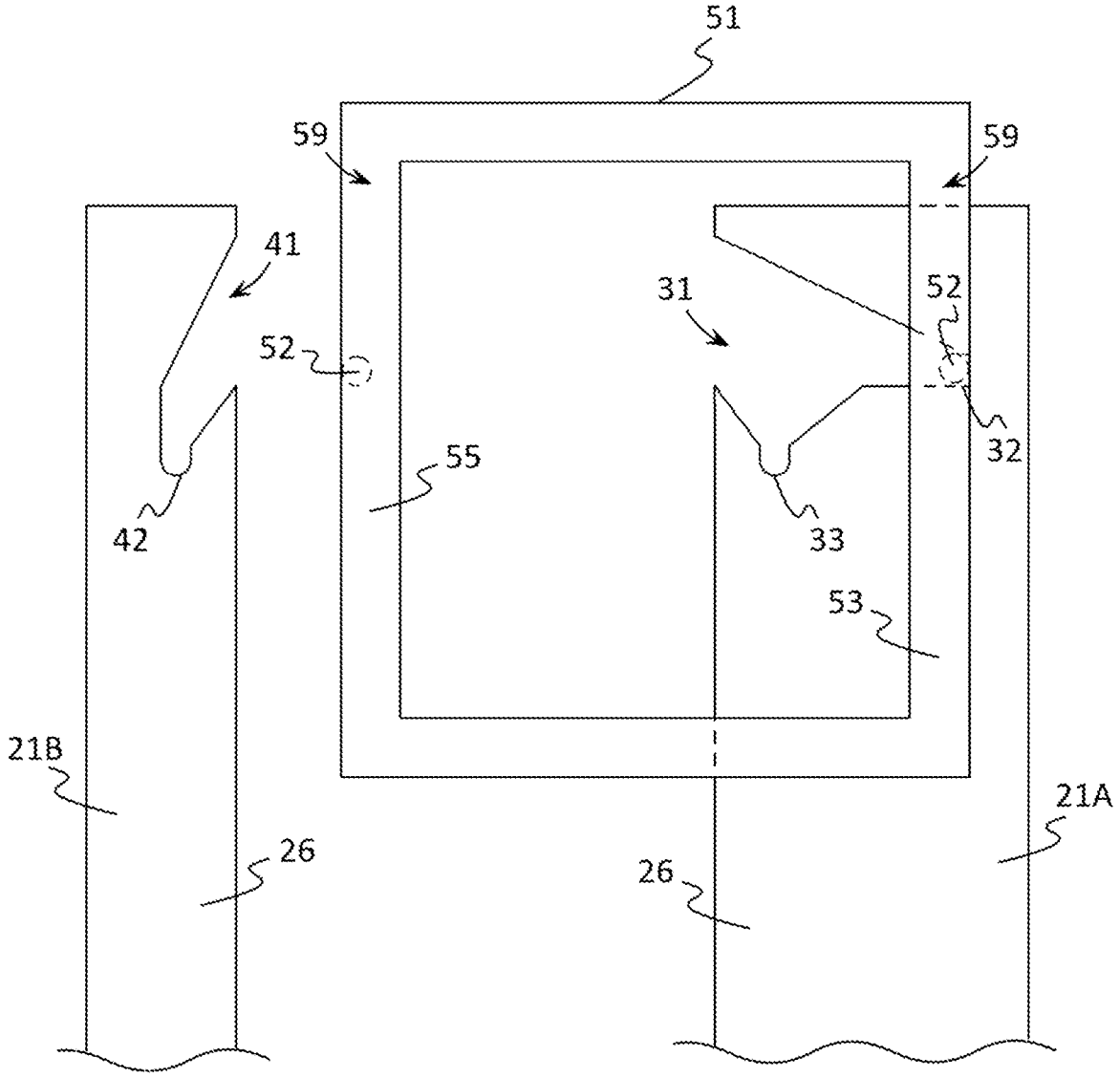
FIG. 14-FIG. 14 shows a schematic diagram (elements not drawn to scale) of the stilts and frame from FIG. 13 according to various embodiments described herein.
Figure 15:
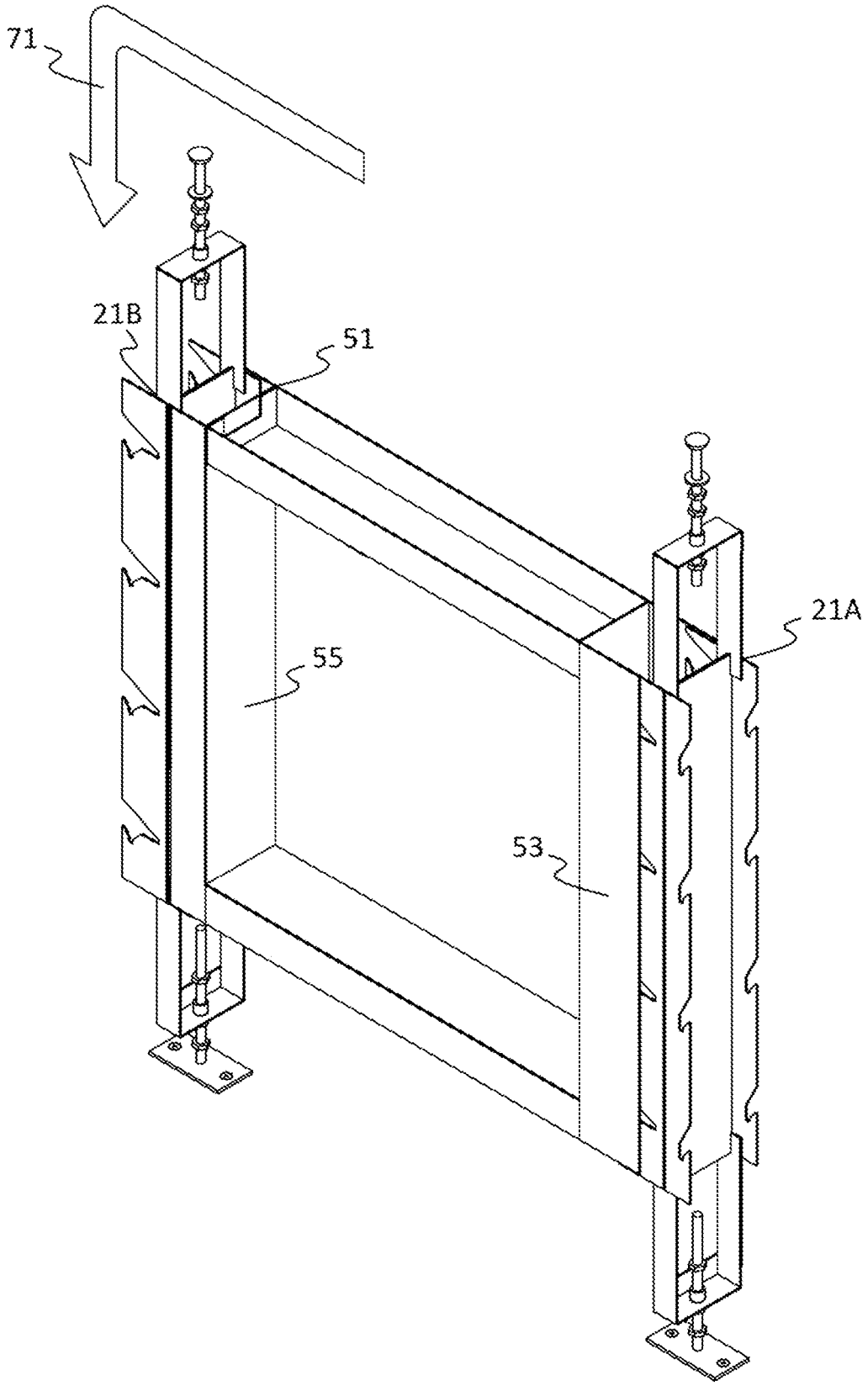
FIG. 15-FIG. 15 depicts a perspective view of the stilts and frame from FIG. 13 in which a pin of the frame is positioned in an active rest of an active receiver of the first stilt and a pin on the opposite side of the frame is positioned in a passive rest of a passive receiver of the second stilt thereby coupling the frame to the stilts according to various embodiments described herein.
Figure 16:
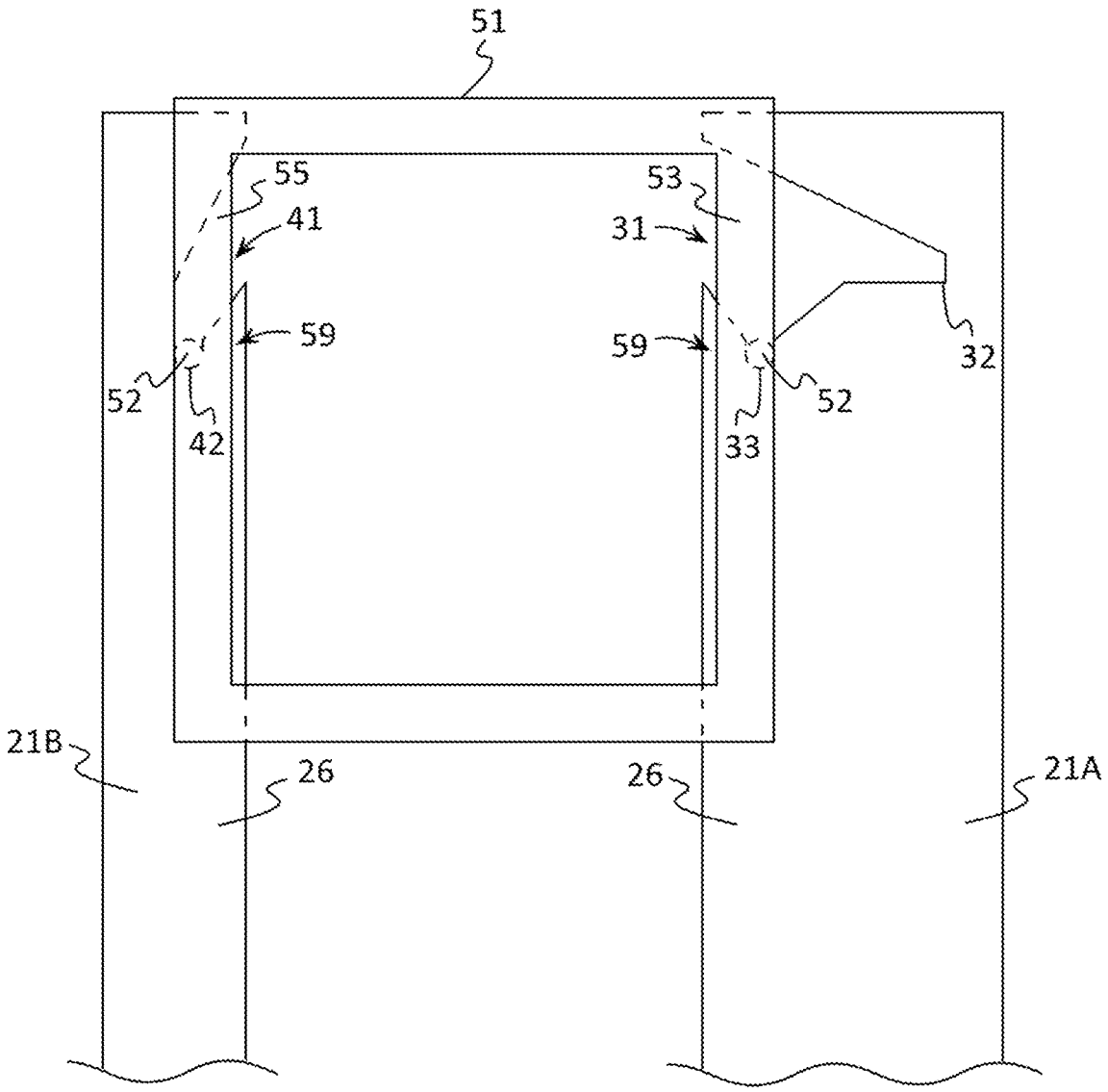
FIG. 16-FIG. 16 illustrates a schematic diagram (elements not drawn to scale) of the stilts and frame from FIG. 15 according to various embodiments described herein.

To couple the frame 51 to the stilts 21A, 21B, the first stilt 21A may be rotated so that the active receivers 31 of the first stilt 21A are slightly turned away (shown by arrow 71 in FIG. 11) from the passive receivers 41 of the second stilt 21B (FIGS. 11 and 12). The frame 51 may then be moved towards the first stilt 21A so that the pins 52 of the first sidewall 53 may be inserted into the easement regions 32 of the active receivers 31 of the first stilt 21A. The frame 51 and first stilt 21A may then be rotated (shown by arrow 71 in FIG. 13) so that the frame 51 is between the two stilts 21A, 21B, (FIGS. 13 and 14) which is made possible by the easement regions 32 extending away from the active rests 33. Next, the frame 51 may be moved towards (shown by arrow 71 in FIG. 15) the second stilt 21B so that the pins 52 of the third sidewall 55 may be inserted into the passive receivers 41 of the second stilt 21B and the pins 52 of the first sidewall 53 may be removed from the easement regions 32 of the active receivers 31 of the first stilt 21A. Finally, the frame 51 may be lowered (also shown by arrow 71 in FIG. 15) so that the pins 52 of the first sidewall 53 may be inserted into the active rests 33 of the active receivers 31 of the first stilt 21A and so that the pins 52 of the third sidewall 55 may be inserted into the passive rests 42 of the passive receivers 41 of the second stilt 21B. In this manner, the frame 51 is supported by the first stilt 21A and the second stilt 21B by placing the pin 52 of the first sidewall 53 in both the first active rest 33 and the second active rest 33 and by placing the second pin 52 of the third sidewall 53 in the first passive rest 42 and the second passive rest 42. Additionally, in this manner, the first body plate 26 and second body plate 26 of the first stilt 21A are positioned in a first channel 59 of the first sidewall 53 and the third body plate 26 and fourth body plate 26 of the second stilt 21B are positioned in a second channel 59 of the third sidewall 53 when the frame 51 is supported by the first stilt 21A and the second stilt 21B.

While some exemplary shapes and sizes have been provided for elements of the system 100, it should be understood to one of ordinary skill in the art that the top rails 11, stilts 21, active receivers 31, passive receivers 41, frame 51, and any other element described herein may be configured in a plurality of sizes and shapes including "T" shaped, "X"

shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the system 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the system 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the system 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the system 100 may be coupled by being one of connected to and integrally formed with another element of the system 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A modular wall gravitational assembly system, the system comprising:

a top rail having a first rail socket and a second rail socket;

a first stilt having a first head, a first active receiver, and a first foot, wherein the first head is configured to be removably coupled to the first rail socket, wherein the first active receiver comprises a first easement region and a first active rest, and wherein the first foot is configured to couple the first stilt to a floor surface;

a second stilt having a second head, a first passive receiver, and a second foot, the second head configured to be removably coupled to the second rail socket, the first passive receiver having a first passive rest, and the second foot configured to couple the second stilt to the floor surface;

a frame having a first pin and a second pin, wherein the frame is supported by the first stilt and the second stilt by placing the first pin in the first active rest and by placing the second pin in the first passive rest; and wherein the first stilt comprises a second active receiver having a second active rest positioned below the first active rest, and wherein the frame is further supported by the first stilt by placing a third pin in the second active rest.

2. The system of claim 1, wherein the first head comprises a spheroid cap shape.

3. The system of claim 2, wherein the first rail socket comprises a passthrough aperture that is in communication with a retaining aperture, wherein the first head is configured to enter and exit the first rail socket via the passthrough aperture, and wherein the first head is configured to be retained in the first rail socket by resting the first head in the retaining aperture.

4. The system of claim 1, wherein the first foot is movable relative to the first active receiver.

5. The system of claim 1, wherein the first head is movable relative to the first active receiver.

6. The system of claim 1, wherein the frame comprises a first channel, wherein the first active receiver is coupled to a first body plate, wherein the second active receiver is coupled to a second body plate, and wherein the first body plate and second body plate are positioned in the first channel when the frame is supported by the first stilt and the second stilt.

7. The system of claim 1, wherein the frame comprises a second channel, wherein the first passive receiver is coupled to a third body plate, wherein a second passive receiver is coupled to a fourth body plate, and wherein the third body plate and fourth body plate are positioned in the second channel when the frame is supported by the first stilt and the second stilt.

8. A modular wall gravitational assembly system, the system comprising:

a top rail having a first rail socket and a second rail socket;

a first stilt having a first head, a first active receiver, and a first foot, wherein the first head is configured to be removably coupled to the first rail socket, wherein the first head comprises a spheroid cap shape, wherein the first head is movable relative to the first active receiver, wherein the first active receiver comprises a first easement region and a first active rest, wherein the first foot is configured to couple the first stilt to a floor surface, and wherein the first foot is movable relative to the first active receiver;

a second stilt having a second head, a first passive receiver, and a second foot, wherein the second head is configured to be removably coupled to the second rail socket, wherein the first passive receiver comprises a first passive rest, and wherein the second foot is configured to couple the second stilt to the floor surface; and a frame having a first pin and a second pin, wherein the frame is supported by the first stilt and the second stilt by placing the first pin in the first active rest and by placing the second pin in the first passive rest.

9. The system of claim 8, wherein the first rail socket comprises a passthrough aperture that is in communication with a retaining aperture, wherein the first head is configured to enter and exit the first rail socket via the passthrough aperture, and wherein the first head is configured to be retained in the first rail socket by resting the first head in the retaining aperture.

10. The system of claim 8, wherein the first stilt comprises a second passive receiver having a second passive rest.

11. The system of claim 10, wherein the first active receiver and the second passive receiver are on opposite sides of the first stilt.

12. The system of claim 11, wherein the frame comprises a first channel, wherein the first active receiver is coupled to a first body plate, wherein a second active receiver is coupled to a second body plate, and wherein the first body plate and second body plate are positioned in the first channel when the frame is supported by the first stilt and the second stilt.

13. The system of claim 10, wherein the frame comprises a second channel, wherein the first passive receiver is coupled to a third body plate, wherein the second passive receiver is coupled to a fourth body plate, and wherein the third body plate and fourth body plate are positioned in the second channel when the frame is supported by the first stilt and the second stilt.

* * * * *